US009103167B2

(12) United States Patent
In

(10) Patent No.: US 9,103,167 B2
(45) Date of Patent: Aug. 11, 2015

(54) ROD-MOUNTING APPARATUS FOR DRILLING APPARATUS

(76) Inventor: Suk Shin In, Gwangju (KR)

( * ) Notice: Subject to any disclaimer, the term of this patent is extended or adjusted under 35 U.S.C. 154(b) by 408 days.

(21) Appl. No.: 13/522,191

(22) PCT Filed: Jan. 19, 2011

(86) PCT No.: PCT/KR2011/000398
§ 371 (c)(1),
(2), (4) Date: Jul. 13, 2012

(87) PCT Pub. No.: WO2011/090320
PCT Pub. Date: Jul. 28, 2011

(65) Prior Publication Data

US 2012/0305233 A1 Dec. 6, 2012

(30) Foreign Application Priority Data

Jan. 19, 2010 (KR) ..... 10-2010-0004926

(51) Int. Cl.
*E21B 19/18* (2006.01)
*E21B 19/15* (2006.01)
*E21B 19/16* (2006.01)

(52) U.S. Cl.
CPC ..... *E21B 19/155* (2013.01); *E21B 19/18* (2013.01); *E21B 19/163* (2013.01)

(58) Field of Classification Search
CPC ..... E21B 19/115; E21B 19/18; E21B 19/20; E21B 19/16; E21B 19/163; E21B 19/15; E21B 19/1635
USPC ..... 166/77.51, 77.52, 77.53, 85.5; 175/203
See application file for complete search history.

(56) References Cited

U.S. PATENT DOCUMENTS 3,280,920 A * 10/1966 Scott ..... 173/44
3,682,259 A * 8/1972 Cintract et al. ..... 175/85
3,860,122 A * 1/1975 Cernosek ..... 414/732
4,303,270 A * 12/1981 Adair ..... 294/207
4,366,606 A * 1/1983 Willis et al. ..... 269/218
4,403,897 A * 9/1983 Willis ..... 414/22.55
4,407,629 A * 10/1983 Willis ..... 414/745.2

(Continued)

FOREIGN PATENT DOCUMENTS

JP 60-144493 A 7/1985
JP 62-129490 U 8/1987

(Continued)

OTHER PUBLICATIONS

English translation of Japanese application 1995-102644.*

*Primary Examiner* — Blake Michener
(74) *Attorney, Agent, or Firm* — Lexyoume IP Meister, PLLC

(57) ABSTRACT

A rod-mounting apparatus for a drilling apparatus is disclosed. The rod-mounting apparatus comprises: a bracket installed at a frame of a main body of the drilling apparatus and having a rod; a base member rotatably mounted on the bracket; a rotating member hinged to one side of the base member to hold and rotate an end of a rod mounted to or separated from a driving shaft; a clamping unit mounted on the rotating member to clamp the end of the rod; and a driving unit mounted on the base member to rotate the rotating member in a direction in which in which the rod makes the rotating member stand or lie. The rod-mounting apparatus of the present invention enables rods to be smoothly connected or separated during a drilling work, thereby improving the drilling efficiency.

3 Claims, 5 Drawing Sheets

(56) References Cited

U.S. PATENT DOCUMENTS

| | | | | |
|---|---|---|---|---|
| 4,718,805 | A * | 1/1988 | Becker | 414/22.54 |
| 4,834,604 | A * | 5/1989 | Brittain et al. | 414/22.55 |
| 5,941,324 | A * | 8/1999 | Bennett | 175/85 |
| 6,634,443 | B1 * | 10/2003 | Paech et al. | 175/85 |
| 8,157,495 | B1 * | 4/2012 | Randall | 414/22.55 |
| 8,839,852 | B2 * | 9/2014 | In | 166/77.53 |
| 2005/0269133 | A1 * | 12/2005 | Little | 175/52 |
| 2008/0164064 | A1 * | 7/2008 | Belik et al. | 175/52 |
| 2009/0057019 | A1 * | 3/2009 | LaValley et al. | 175/85 |
| 2009/0238663 | A1 * | 9/2009 | Littlely | 414/22.54 |
| 2009/0279987 | A1 * | 11/2009 | Jantzen | 414/22.53 |
| 2010/0104401 | A1 * | 4/2010 | Hopkins et al. | 414/22.54 |
| 2010/0187740 | A1 * | 7/2010 | Orgeron | 269/218 |
| 2010/0308609 | A1 * | 12/2010 | LaValley et al. | 294/81.61 |
| 2011/0048807 | A1 * | 3/2011 | In | 175/195 |
| 2013/0327541 | A1 * | 12/2013 | Gustafsson et al. | 166/380 |

FOREIGN PATENT DOCUMENTS

| | | | |
|---|---|---|---|
| JP | 08-296388 | A | 11/1996 |
| JP | 08-296389 | A | 11/1996 |
| KR | 10-2009-0007420 | A | 1/2009 |
| KR | 10-0916667 | B1 | 9/2009 |

* cited by examiner

ROD-MOUNTING APPARATUS FOR DRILLING APPARATUS

TECHNICAL FIELD

The present invention relates to a drilling (or boring) apparatus, and more particularly, to a rod-mounting apparatus for a drilling apparatus, which mounts or separates rods rotated by a driving shaft of a head part during a drilling work.

BACKGROUND ART

In general, a drilling apparatus for boring a hole into the ground is based on a technique of simply circulating a bit or a screw, or a technique of not only circulating a bit or a ball cutter but also pressurizing the same. According to the latter method, the ground is bored by rotating a bit installed at an end portion of a rod and air-suctioning circulating water and cloven rocks through a drill rod pipe, followed by hoisting the rocks to the surface of the ground. This method is essentially employed in a large-diameter cast-in-place and a top-down method for a foundation work.

Meanwhile, in the course of performing a drilling work, the drilling apparatus mounts or separates a rod having a bit installed thereat or length-extending rods as a drilling depth increases. During a mounting operation of the length-extending rods, a rod for drilling the ground is connected to a driving shaft installed at a head part. In the mounting operation of the length-extending rods, since suspending the rod using a separate crane and setting the same are manually performed, the number of works required in mounting rods may increase.

In the conventional drilling apparatus, in order to smoothly perform the rod mounting operation, a cartridge is installed at a lateral surface of a lid, and the cartridge is rotated toward a lower portion of the driving shaft of the head part to exchange rods or to store withdrawn rods.

The conventional drilling apparatus requires separate equipment for mounting rods on the cartridge. In addition, a considerable time is required in mounting rods on the cartridge. In addition, when a deep hole is drilled, the number of rods required may increase. However, since the number of rods loaded into the cartridge is limited, it is quite difficult for the conventional drilling apparatus to be employed to boring a deep hole.

In light of the foregoing, in order to bore a relatively deep hole, multiple rods are carried using a truck to a construction site where the drilling work is performed. The rods are lifted from the truck using an auxiliary crane to then be mounted on the driving shaft of the head part installed at the lid. Thus, the rod mounting efficiency cannot be improved.

DISCLOSURE OF THE INVENTION

In order to overcome the above-mentioned shortcomings, the present invention provides a rod-mounting apparatus for a drilling apparatus, which can improve a drilling work of boring the underground by reducing the number of works required in mounting and separating rods.

The present invention also provides a rod-mounting apparatus for a drilling apparatus, which can improve the mounting accuracy in connecting a rod to a driving shaft of a head part.

The present invention also provides a rod-mounting apparatus for a drilling apparatus, which can prevent a rod from being dislodged from a holding part even after a holding force of a clamping unit is removed.

According to an aspect of the invention, there is provided a rod-mounting apparatus including a bracket installed at a frame of a main body of the drilling apparatus and having a rod, a base member rotatably mounted on the bracket, a rotating member hinged to one side of the base member to hold and rotate an end of a rod mounted to or separated from a driving shaft, a clamping unit mounted on the rotating member to clamp the end of the rod, and a driving unit mounted on the base member to rotate the rotating member in a direction in which in which the rod makes the rotating member stand or lie.

The bracket may further include a driving unit for rotating the base member with respect to the bracket at a predetermined angle.

The driving unit may be installed under the base member and may include a rotation shaft rotatably supported to the bracket, a rotation link radially extending from the rotation shaft, and a rotating cylinder installed between the frame of the main body and the rotation link and driving the rotation shaft.

The clamping unit may include a fixed jaw installed at a top surface of the rotating member, a movable jaw rotatably installed by a hinge shaft with the fixed jaw and forming a holding part holding an end of the rod, and a driving cylinder installed between the rotating member and the movable jaw and rotating the movable jaw with respect to the fixed jaw.

The driving cylinder may have a stroke in which the movable jaw is rotated so as to prevent the rod supported to the holding part in a state in which the movable jaw is opened by the fixed jaw from being dislodged from the holding part opened between the fixed jaw and the movable jaw.

Advantageous Effects

As described above, in the rod-mounting apparatus for a drilling apparatus according to the present invention, since the rod can be rotated for mounting/separating the rod to/from the driving shaft of the head part in a state in which its end portion is clamped, the number of works required for rod mounting or separation can be reduced, thereby maximizing the drilling efficiency when a drilling work is performed using the drilling apparatus.

Since the rod can be moved toward a lower portion of the driving shaft of the head part in a state in which the rod mounted on a truck is clamped by a clamping unit, a separate crane is not required. In addition, even after a clamping force applied to the rod is removed, the rod can be prevented from being dislodged from the clamping unit, thereby preventing a safety-related accident.

BRIEF DESCRIPTION OF THE DRAWINGS

The objects, features and advantages of the present invention will be more apparent from the following detailed description in conjunction with the accompanying drawings, in which.

BEST MODE FOR CARRYING OUT THE INVENTION

Figure 1:
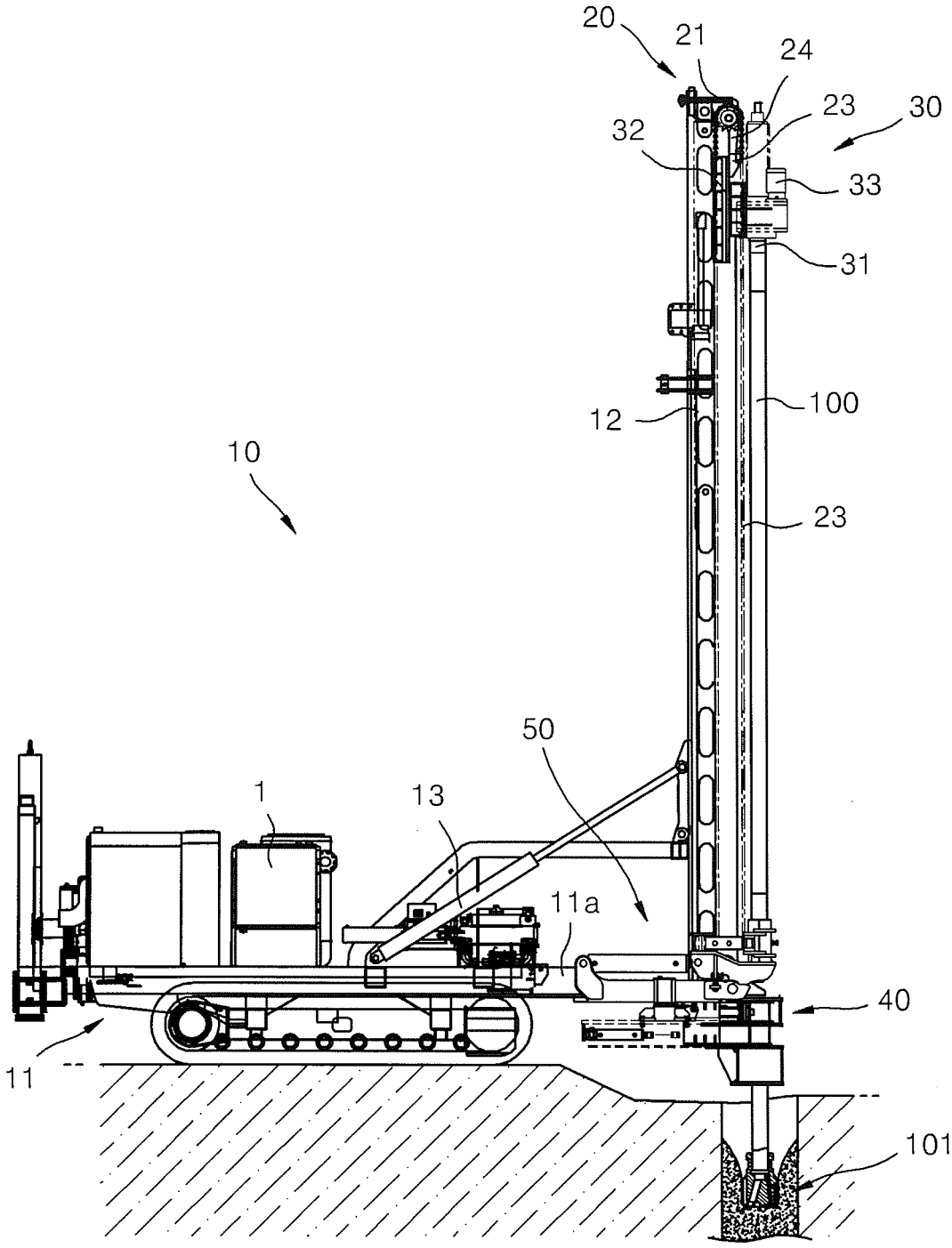
FIG. 1 is a side view of a drilling apparatus having a rod-mounting apparatus according to an embodiment of the present invention.

Hereinafter, embodiments of the present invention will be described in detail with reference to the accompanying drawings.

The drilling apparatus according to the present invention includes a rod-mounting apparatus is mounted/separated to/from a rod that performs a drilling work and is capable of supplying or withdrawing rods for varying a rod length, and exemplary embodiment thereof are illustrated in FIGS. 1 to 5. Referring to FIGS. 1 to 5, the drilling apparatus 10 includes a lid 12 installed thereat or on a main body 11 thereof, and a head part 30 slidably installed at the lid 12, lifted or lowered by lifting means 20 and having a driving shaft 31 coupled to the rod 100. A bit unit 101 is installed at an end of the rod 100 coupled to the driving shaft 31. In order to achieve rod mounting or separation, a tool clamping unit 40 for clamping the rod 100 is installed at a lower end of the lid 12. In addition, a rod mounting unit 50 for clamping an end of the rod 100 and supplying and withdrawing the rod 100 is provided at a lower portion of the lid 12 or on the frame 11*a* of the main body 11 adjacent to the lid 12.

The aforementioned drilling apparatus including the rod-mounting apparatus according to the present invention will now be described in detail.

Although not shown, a hydraulic oil supply unit and control valves for pumping and supplying hydraulic oil to hydraulic cylinders and hydraulic motors may be provided in the drilling apparatus 10 itself or on the main body 11 of the drilling apparatus 10. The hydraulic oil supply unit includes a hydraulic oil tank, and an engine for driving a hydraulic pump for pumping hydraulic oil from the hydraulic oil tank. Separate moving means may also be installed in the main body 11.

In addition, the lid 12 is rotated by cylinders 13 installed between the main body 11 and the lid 12.

The head part 30 is lifted or lowered along the lid 12 by the lifting means 20 and rotates and lifts or lowers the rod 100 connected to the driving shaft 31 and the driving shaft 31 and a driving motor 33 for forwardly or reversely rotating the driving shaft 31 are installed at a lifting frame 32 lifted or lowered along the lid 12. A hydraulic motor may be used as the driving motor 33 for driving the driving shaft 31.

The lifting means 20 includes sprockets 21 installed at upper and lower portions of the lid 12, a chain 23 locked on the sprockets 21 and connected to the lifting frame 32 of the head part 30, and a hydraulic motor (not shown) installed at the lid 12 and driving one of the sprockets 21. The lifting means 20 is not limited to the illustrated lifting means and may be implemented by a cylinder, a winch or a rope installed at the lid 12.

Figure 2:
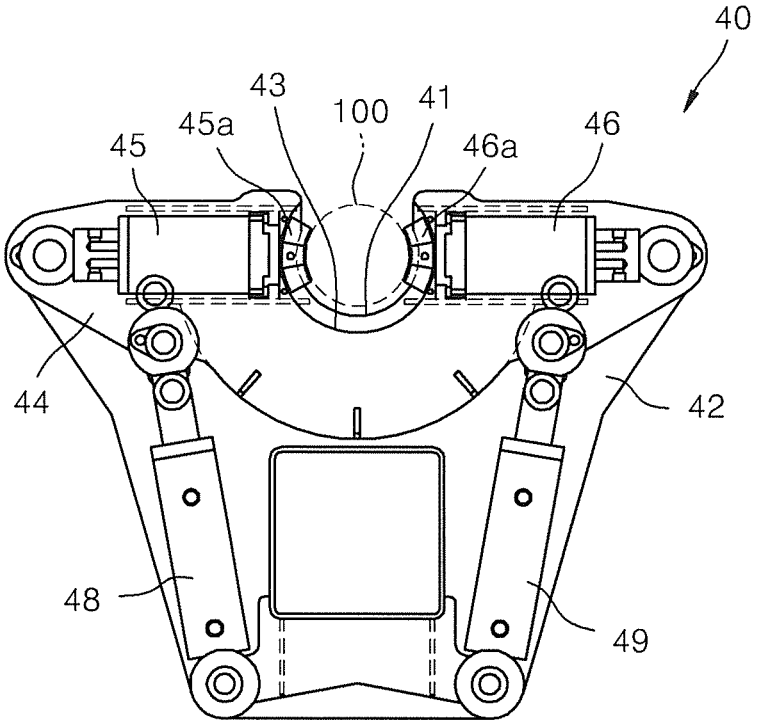
FIG. 2 is a plan view illustrating a tool clamp is mounted in the drilling apparatus.

The tool clamping means 40 is installed at a lower end of the lid 12 or on the frame 11*a* and clamps a rod mounted or separated. As shown in FIG. 2, the tool clamping means 40 includes a supporting frame 42 having a first hole 41 through which the rod 100 penetrates, and a movable frame 44 installed so as to be rotatable with respect to the first hole 41 of the supporting frame 42 and having a second hole 43 shaped to correspond to the first hole 41.

Jaws 45*a* and 46*a* for holding the rod 100 passing through the second hole 43 are slidably installed at the movable frame 44 of opposite sides of the second hole 43. The respective jaws 45*a* and 46*a* move back and forth by first and second hydraulic cylinders 45 and 46 installed at the movable frame 44. In addition, the movable frame 44 is rotated by third and fourth hydraulic cylinders 48 and 49 connecting the supporting frame 42 and the movable frame 44. That is to say, in a state in which the rod 100 is clamped on the movable frame 44 by the jaws 45*a* and 46*a*, the movable frame 44 is rotated with respect to the supporting frame 42, thereby rotating the clamped rod 100.

Figure 3:
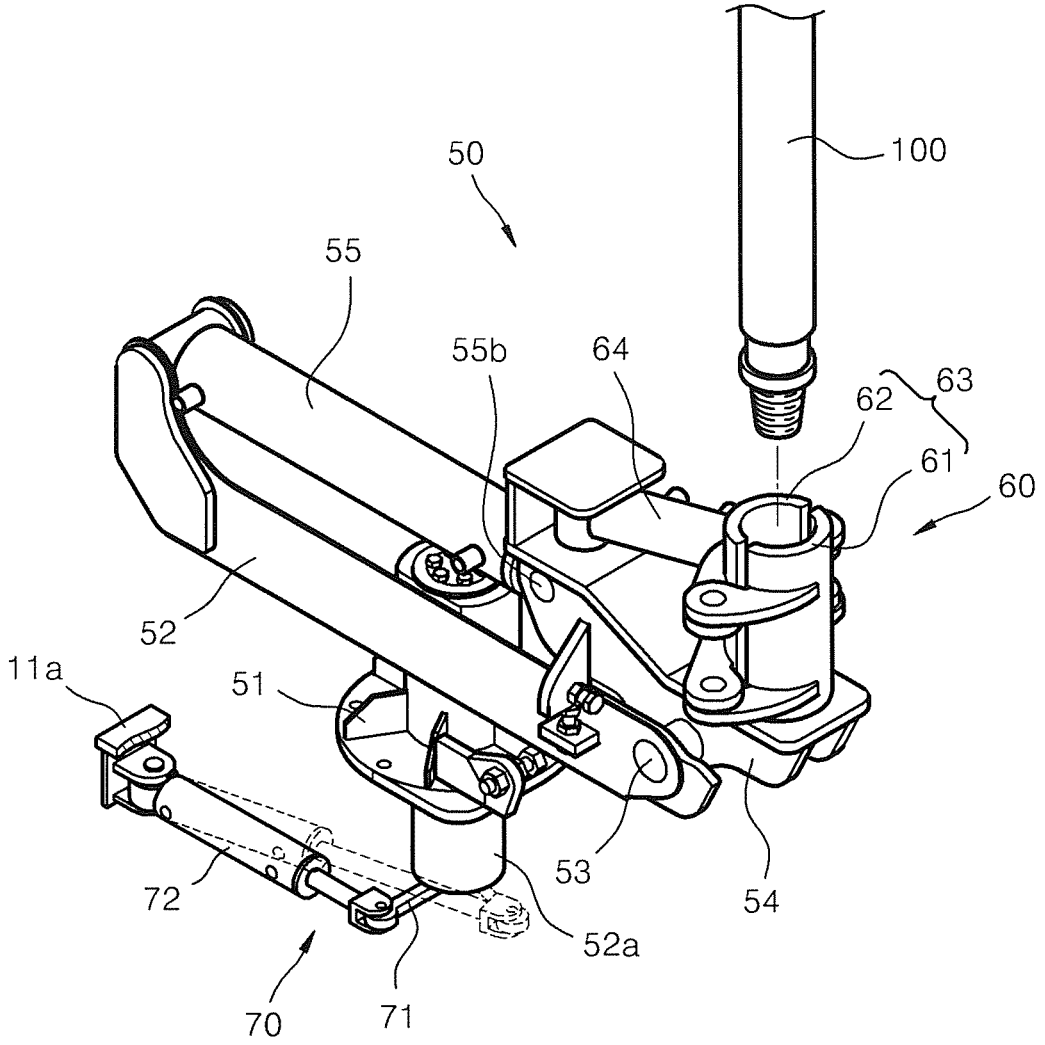
FIG. 3 is an exploded perspective view of a rod-mounting apparatus according to the present invention.
Figure 4:
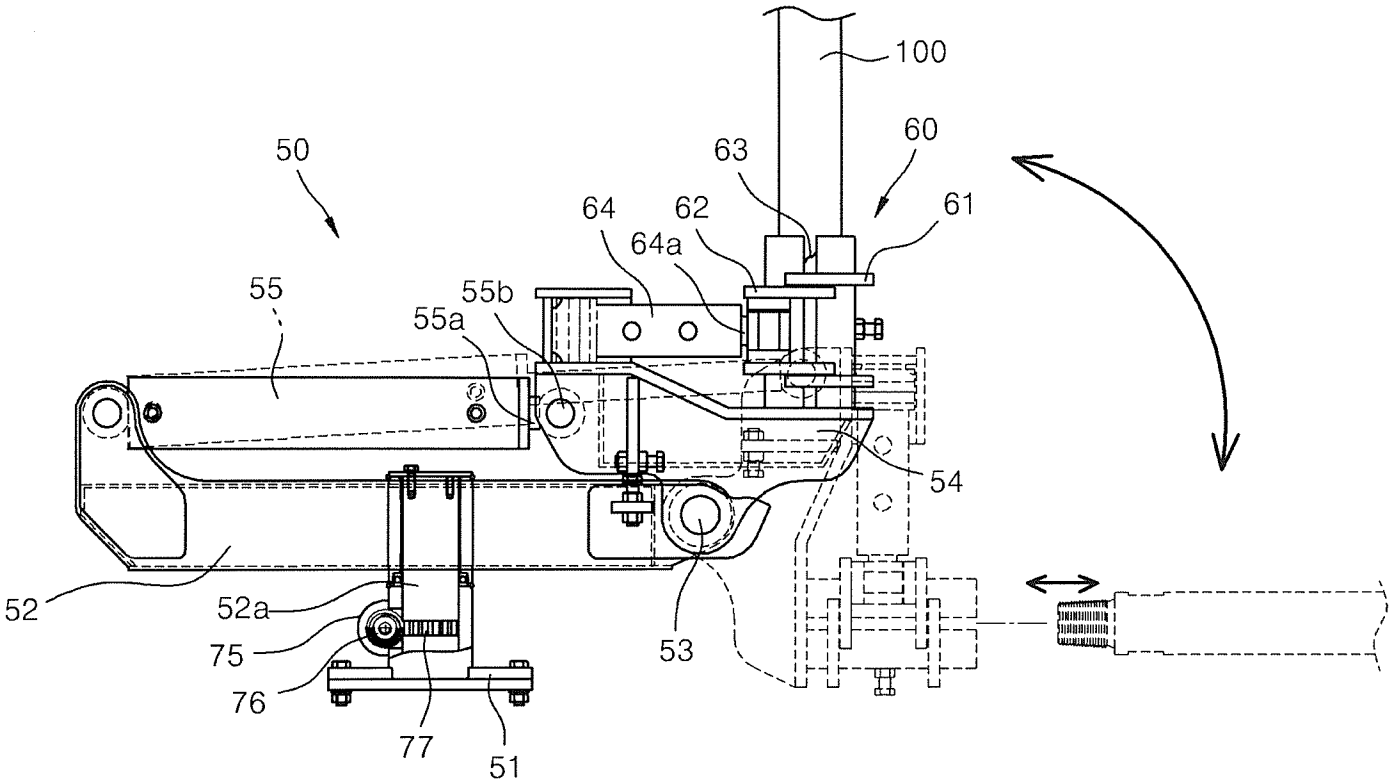
FIG. 4 is a side view of a drilling apparatus having a rod-mounting apparatus according to another embodiment of the present invention.

The rod mounting unit 50 is rotated in a state in which the end of the rod 100 is clamped to allow the rod 100 to be connected to or disconnected from the driving shaft 31 of the head part 30, and an exemplary embodiment thereof is illustrated in FIGS. 3 and 4.

Referring to FIGS. 3 and 4, the rod mounting unit 50 is configured such that a base member 52 is rotatably installed in a bracket 51 installed at a lower portion of the lid 12 or on the frame 11*a* of the main body 11.

In addition, the rod mounting unit 50 includes a rotating member 54 connected to one side of the base member 52 by a hinge shaft 53 and rotating in a vertical or horizontal state, a clamping unit 60 installed in the rotating member 54 and clamping an end of the rod 100, and an actuator mounted on the base member 52 to rotate the rotating member 54 in a direction in which the rod 100 makes the rotating member 54 stand or lie.

The actuator may be a hydraulic cylinder 55. The hydraulic cylinder 55 as the actuator has one side thereof rotatably supported to the base member 52, and a rod 55*a* of the hydraulic cylinder 55 is rotatably coupled to one side of the rotating member 54 by a pin 55*b*.

As the base member 52 is rotated with respect to the bracket 51, a rotation shaft 52*a* is installed at a lower portion of the base member 52, and the rotation shaft 52*a* is rotatably installed at the bracket 51.

The base member 52 rotatably installed at the bracket 51 may be rotated by a separate driving unit 70. As shown in FIG. 3, the driving unit 70 includes a rotation link 71 installed at the rotation shaft 52*a* and a rotating cylinder 72 installed between the frame 11*a* and the rotation link 71. As shown in FIG. 4, as the rotation shaft 52*a* rotates, the driving unit 70 includes a hydraulic motor 75, a driving gear 76 driven by the hydraulic motor 75, and a driven gear 77 installed at the rotation shaft 52*a*.

The clamping unit 60 clamps an end of the rod 100. A fixed jaw 61 is installed on a top surface of the rotating member 54, and a movable jaw 62 coupled to the fixed jaw 61 by a hinge shaft 61 is rotatably installed on the fixed jaw 61 to clamp the end of the rod 100. When the fixed jaw 61 and the movable jaw 62 are coupled to each other, they form a cylindrical holding part 63 to surround the end of the rod 100. A length of the fixed jaw 61 is preferably 3 to 5 times a diameter of a circle formed when the fixed jaw 61 and the movable jaw 62 are coupled to each other, thereby preventing the rod 100 from being dislodged during rotation by holding the end of the rod 100.

The movable jaw 62 is connected to or disconnected from the fixed jaw 61 by a driving cylinder 64 as the actuator installed in the rotating member 54. The driving cylinder 64 is rotatably installed in the rotating member 54, and a driving cylinder rod 64*a* is coupled to an end of the movable jaw 62 rotatably installed in the rotating member 54 by a pin connection. Here, when the movable jaw 62 is maximally opened with respect to fixed jaw 61, a stroke of the driving cylinder 64 is preferably smaller than the length of the diameter of the rod 100 so as to prevent the rod 100 from being dislodged from the holding part 63 formed by the fixed jaw 61 and the movable jaw 62. That is to say, even if a force of the fixed jaw 61 holding the end of the rod 100 is removed by the movable jaw 62, the rod 100 should be withdrawn only in a lengthwise direction of the fixed jaw 61 without collapsing.

The clamping unit 60 is not limited to the illustrated clamping unit and any type of clamping unit can be used as long as it can hold the end of the rod 100.

The aforementioned drilling apparatus and the rod-mounting apparatus according to the present invention operate as follows.

In order to perform a drilling work using the drilling apparatus according to the present invention, the head part 30 is lifted using lifting means in a state the lid 12 is maintained at a vertical state.

In this state, as shown in FIG. 4, the hydraulic cylinder as the actuator 55 of the rod mounting unit 50 is driven to rotate the rotating member 54 installed at an end of the base member 52, thereby making the holding part 63 formed by the fixed jaw 61 and the movable jaw 62 of the clamping unit 60 face frontward. In this state, the driving cylinder 64 is driven to rotate the movable jaw 62 with respect to the fixed jaw 61 so as to be opened. Then, the end of the rod 100 is inserted into the holding part 63 formed between the fixed jaw 61 and the movable jaw 62 and the driving cylinder 64 is then driven to hold the end of the rod 100

Figure 5:
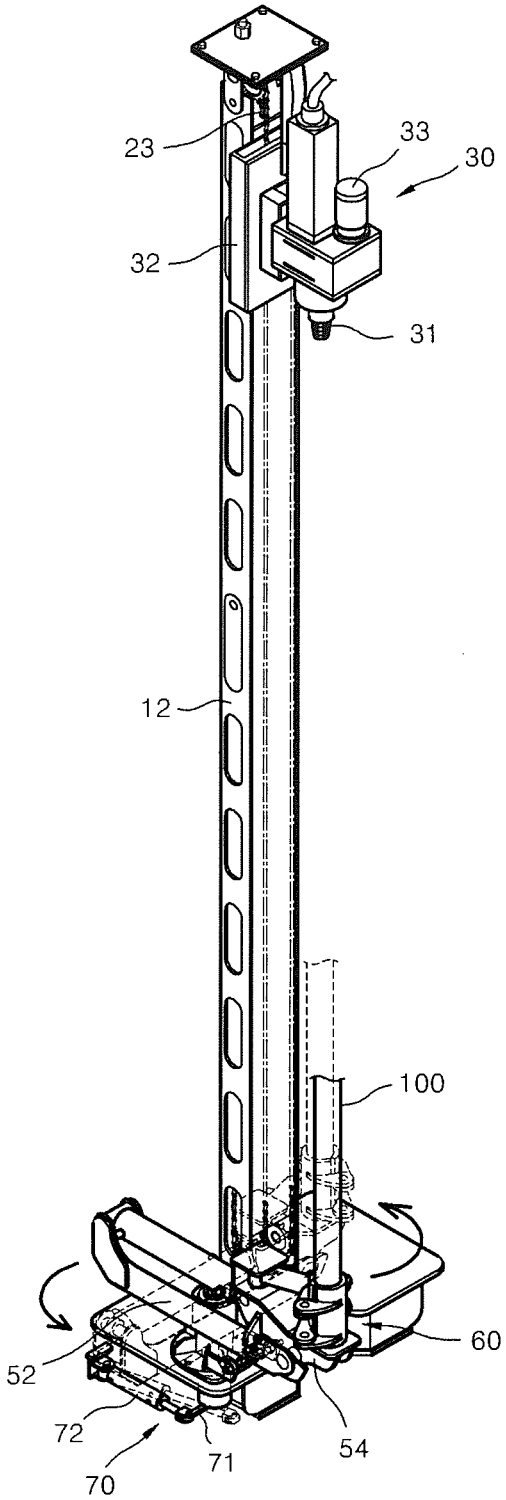
FIG. 5 is a perspective view illustrating the operation of the rod-mounting apparatus according to the present invention.

Then, the hydraulic cylinder as the actuator 55 is driven to rotate the rotating member 54 with respect to the base member 52, thereby maintaining the rod 100 clamped by the clamping unit at a vertical state, as shown in FIG. 5. As described above, if the rod 100 is maintained at the vertical state, the rotating cylinder 72 of the driving unit 70 is driven to rotate the base member 52, thereby allowing the vertically maintained rod 100 to be positioned at a lower portion the driving shaft 31 of the head part 30. In this state, the head part 30 is lowered, thereby allowing the rod 100 and the driving shaft 31 to be connected to each other. If connection of the driving shaft 31 and the rod 100 is completed, the driving cylinder 64 is driven to rotate the movable jaw 62, thereby removing a holding state of the rod 100. Then, the head part 30 is lifted to separate the rod 100 from the holding part 63 of the clamping unit 60 to then rotate the base member 52 by the driving unit 70.

After the drilling work of the underground is completed, in order to separate the rod 100 connected to the driving shaft 31 from the driving shaft 31, the head part 30 is lifted along the lid 12 to allow the rod 100 to be separated and positioned downward to be positioned in the first and second holes 41 and 43 of the tool clamping means 40. Then, the first and second hydraulic cylinders 45 and 46 are driven to hold the rod 100 by the jaws 45*a* and 46*a* and to hold a rod positioned upward using a range (not shown). The third and fourth hydraulic cylinders 48 and 49 are driven to connect the fixed frame 42 and the movable frame 44 to rotate the movable frame 44 with respect to the fixed frame 42, thereby rotating the connected rods 100 relative to each other. In this state, the driving shaft 31 is reversely rotated to separate the rod 100, that is, the rod connected to the driving shaft 31, and the rod clamped by the tool clamping means 40 from each other, thereby lifting the head part 30 and lifting the separated rods.

Then, the base member 52 is rotated to allow the clamping unit 60 to be positioned at a lower portion of the rod 100, an end of the rod 100 supported to the driving shaft 31 is clamped by the clamping unit 60, the driving shaft 31 is reversely rotated to separate the driving shaft 31 and the rod 100 from each other. The hydraulic cylinder 55 as the actuator is driven to rotate the rotating member 54 with respect to the base member 52 to make the rod 100 lie. Then, a clamping force applied by the fixed jaw 61 and the movable jaw 62 of the clamping unit 60 is removed to separate the rod 100 from the holding part 63.

As described above, since the drilling apparatus according to the present invention supplies or withdraws rods by the rod-mounting apparatus, inconvenience or burdens associated with connecting or separating rods can be reduced. In addition, the number of works required for exchanging rods can also be reduced. Further, the drilling efficiency can be maximized.

Although exemplary embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined by the appended claims.

What is claimed is:

1. A rod-mounting apparatus for a drilling apparatus, comprising:

a bracket disposed under a lid which is mounted on a main body of the drilling apparatus;

a base member rotatably mounted on the bracket;

a rotating member hinged to one side of the base member to hold an end of a rod which is connected to or separated from a driving shaft which is mounted on the lid and to rotate the rode;

a clamping unit mounted on the rotating member to clamp the end of the rod; and an actuator installed on the base member to rotate the rotating member in a direction that the rod is being rotated between a vertical and horizontal position, wherein the clamping unit includes a fixed jaw fixed on a top surface of the rotating member, a movable jaw rotatably installed on the fixed jaw with a hinge shaft and forming a holding part, in which the end of the rod is inserted, along with the fixed jaw, and a driving cylinder connected between the rotating member and the movable jaw and rotating the movable jaw with respect to the fixed jaw and wherein a stroke span of the driving cylinder by which the movable jaw is rotated to be opened from the fixed jaw is restricted in a range that the rod is prevented from being dislodged from the holding part when the movable jaw is maximally opened from the fixed jaw, the movable and fixed jaws each comprising an elongated half-cylinder that axially extends beyond each side of a pair of axially spaced arms joining the fixed and movable jaws, thereby forming the hinge shaft.

2. The rod-mounting apparatus of claim 1, further comprising a driving unit for horizontally rotating the base member with respect to the bracket at a predetermined angle, thereby moving the clamping unit to be positioned under the driving shaft to enable connection between the driving shaft and the rod clamped by the clamping unit.

3. The rod-mounting apparatus of claim 2, wherein the driving unit is installed under the base member and includes a rotation shaft rotatably supported by the bracket, a rotation link radially extending from the rotation shaft, and a rotating cylinder installed between the main body and the rotation link and driving the rotation shaft.

* * * * *